US005368162A

United States Patent [19]

Holmgren

[11] Patent Number: 5,368,162

[45] Date of Patent: Nov. 29, 1994

[54] SAFETY DEVICE FOR PARALLELEPIPEDIC BOX

[75] Inventor: Bertil Holmgren, Vellinge, Sweden

[73] Assignee: M W Trading APS, Glyngore, Denmark

[21] Appl. No.: 39,022

[22] PCT Filed: Oct. 28, 1991

[86] PCT No.: PCT/SE91/00722

§ 371 Date: Mar. 25, 1993

§ 102(e) Date: Mar. 25, 1993

[87] PCT Pub. No.: WO92/08026

PCT Pub. Date: May 14, 1992

[30] Foreign Application Priority Data

Oct. 26, 1990 [SE] Sweden ..... 9003424-0

[51] Int. Cl.[5] ..... B65D 85/30; A45C 13/18

[52] U.S. Cl. ..... 206/387; 206/807; 206/1.5; 220/315; 220/324; 292/201; 292/96

[58] Field of Search ..... 206/1.5, 387, 807; 70/276; 292/144, 201, 96; 220/315, 324, 326

[56] References Cited

U.S. PATENT DOCUMENTS

| | | | |
|---|---|---|---|
| D. 313,412 | 1/1991 | Holmgren . | |
| 3,48,907 | 11/1974 | Shiurila . | |
| 767,298 | 8/1904 | Louis | 292/201 |
| 971,423 | 9/1910 | Walters | 292/201 |
| 1,092,651 | 4/1914 | Jordan, Jr. . | |
| 1,173,399 | 2/1916 | Van Orden . | |
| 1,255,894 | 2/1918 | Krueger . | |
| 2,557,436 | 6/1951 | Isserstedt . | |
| 3,150,894 | 9/1964 | Sant | 292/201 |
| 3,495,716 | 2/1970 | Gregory . | |
| 3,677,396 | 7/1972 | Staar . | |
| 3,828,922 | 8/1974 | Holkestad . | |
| 3,933,240 | 1/1976 | Humble . | |
| 4,046,255 | 9/1977 | Ackeret | 206/1.5 |
| 4,096,718 | 6/1978 | Michelman et al. . | |
| 4,280,724 | 7/1981 | Dalton . | |
| 4,285,429 | 8/1981 | MacTavish . | |
| 4,466,540 | 8/1984 | Lotrous et al. . | |
| 4,589,549 | 5/1986 | Hehn . | |
| 4,641,747 | 2/1987 | Mestdagh et al. . | |
| 4,819,797 | 4/1989 | Holmgren . | |
| 4,964,510 | 10/1990 | Loyd . | |
| 4,966,020 | 10/1990 | Fotheringham et al. . | |
| 5,147,034 | 9/1992 | Broadhead | 206/387 |

FOREIGN PATENT DOCUMENTS

| | | |
|---|---|---|
| 0308810 | 3/1989 | European Pat. Off. . |
| 0312172 | 4/1989 | European Pat. Off. . |
| 2259855 | 3/1977 | Germany . |
| 2735151 | 2/1979 | Germany . |
| 8422027 | 10/1984 | Germany . |
| 461121 | 1/1990 | Sweden . |
| 531868 | 2/1973 | Switzerland . |
| 9551 | of 1908 | United Kingdom . |
| WO92/18734 | 10/1992 | WIPO . |

*Primary Examiner*—Paul T. Sewell
*Assistant Examiner*—M. D. Patterson
*Attorney, Agent, or Firm*—Merchant, Gould, Smith, Edell, Welter & Schmidt

[57] ABSTRACT

A theft prevention device to be mounted on a parallelepipedic box, the device including a frame with an insert opening for enclosing the box. The frame is provided with a hook shaped lock tongue, displaceably and pivotally mounted to the frame. The hooked shaped lock tongue may be moved from an engaged position on the frame where it blocks the insert opening, to a position where it can be disengaged to not block the insert opening to allow removal of the box from the frame. A latch having a rotary bolt holds the hook shaped lock tongue in the engaged position. This latch can be adjusted to free the lock tongue, for it to be moved from the engaged position where it can be disengaged from the frame.

9 Claims, 3 Drawing Sheets

SAFETY DEVICE FOR PARALLELEPIPEDIC BOX

Figure 1:
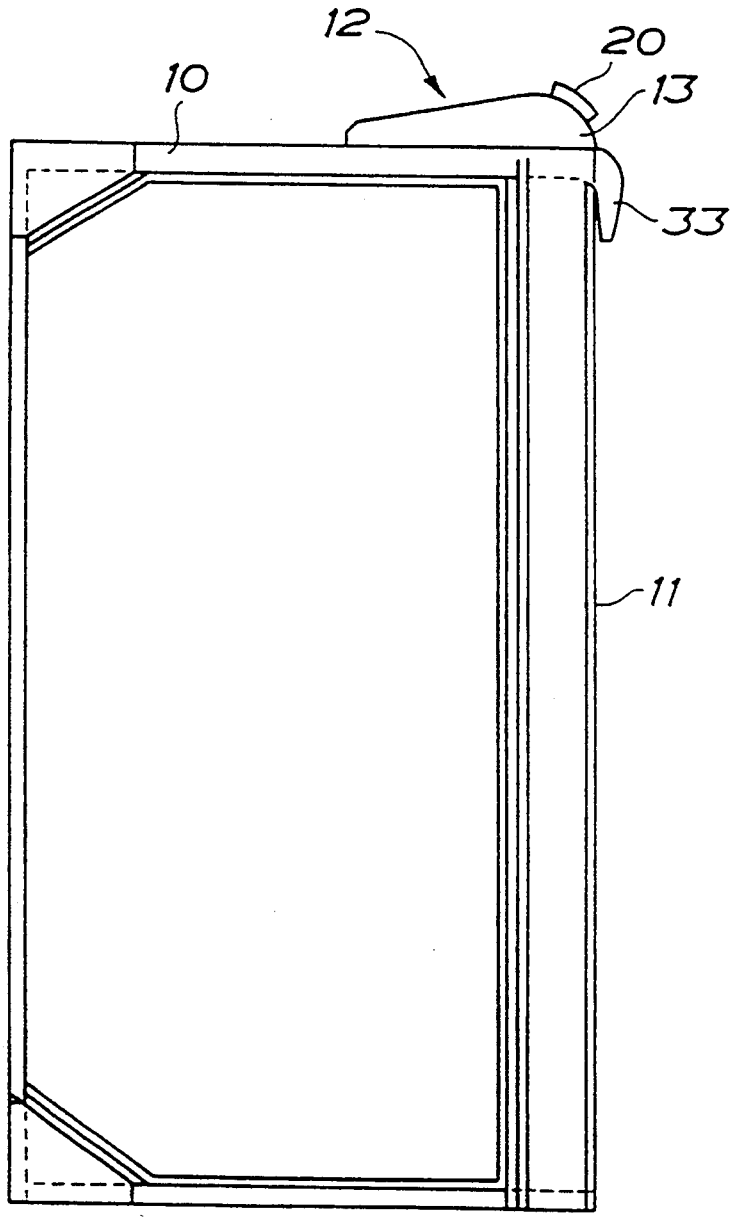

The invention relates to a theft-prevention device to be placed on a parallelepipedic box, comprising a frame constructed to enclose the box, said frame forming an insert opening for the box and having a lock mechanism including a lock bolt which can be adjusted between an engaged position and a disengaged position, said lock bolt preventing that a box inserted into the frame is withdrawn therefrom, and a latch mechanism maintaining the lock bolt in the engaged position thereof, which can be actuated by an external element for releasing the lock bolt for movement to the disengaged position and thus withdrawal of the box from the frame through the insert opening.

A theft-prevention device of this type is described in WO 90/07183. The embodiment described therein is intended for boxes for compact discs and the like, a rotary bolt preventing withdrawal of the box from the frame by direct engagement with the box. There are, however, also other relatively expensive products which need to be protected against theft, and recorded video cassettes are one exampe of such products. These cassettes are available in boxes which are delivered, however, not by the manufacturer of the video cassette but by local distributors. The boxes which usually are made of plastic therefore are of many different types and as a consequence thereof are difficult to protect against theft because a theft-prevention device fitting a box of one type is not at all suitable for a box of another type. Moreover, these plastic boxes are clumsy and expensive.

A far better box for video cassettes is the cardboard box which is delivered by the manufacturer of the video cassette but only for unrecorded cassettes. The purpose of the present invention is to provide a theft-prevention device which is well suited for application to video cassettes in cardboard boxes so that the use of boxes of this type also for recorded video cassettes will be stimulated with the advantages associated therewith. A drawback of the cardboard boxes in this connection is, however, that the boxes are manufactured with great tolerances and that the cardboard box is yieldable and elastic. There may be dimensional deviations in the length and width measures of the cassette of the order of 1.5 to 2 mm, and then, if the locking pin of the rotary bolt is of the order of 3 to 4 mm as in the present embodiments of the theft-prevention device according to WO 90/07183, intended for compact disc boxes, it is easy for less scrupulous persons to pry the frame loose from the cardboard box and thus to bring the theft-prevention device out of use. This could of course be prevented by making the locking pin of the rotary bolt larger, but this means that the lock mechanism as a whole will be larger, which cannot be accepted commercially partly because the general opinon is that theft-prevention devices of the kind referred to herein are too large and ugly however small and slender they are made, and partly because it is desired to use for adjustment of the lock mechanism to the disengaged position one and the same apparatus wherein the external actuation member is provided (usually a powerful magnet), which means that the lock mechanism should be of a unitary embodiment if it is mounted to a theft-prevention device for one article or the other.

Taking these circumstances and wishes into account the invention proposes a theft-prevention device of the kind referred to above with the characterizing features of claim 1 whereby it is possible that the element engaging the cassette and preventing withdrawal thereof from the frame can be made arbitrarily large but irrespective of said element being large or small can be locked in the blocking position by means of one and the same lock mechanism of the small and convenient embodiment now available.

Although the invention is said to have been created particularly for cardboard boxes for video cassettes it should be stressed already now that the invention is not limited to theft-prevention devices for this specific product. The invention can be applied to other types of parallelepipedic boxes. A further example that can be mentioned are multipack of compact discs and music cassettes which are available sometimes with and sometimes without a cellophane wrap with accompanying dimensional discrepancy.

The invention also relates to the lock means per se, forming part of the theft-prevention device according to the invention, said lock means comprising a lock mechanism and a lock tongue in accordance with claim 7.

Figure 2:
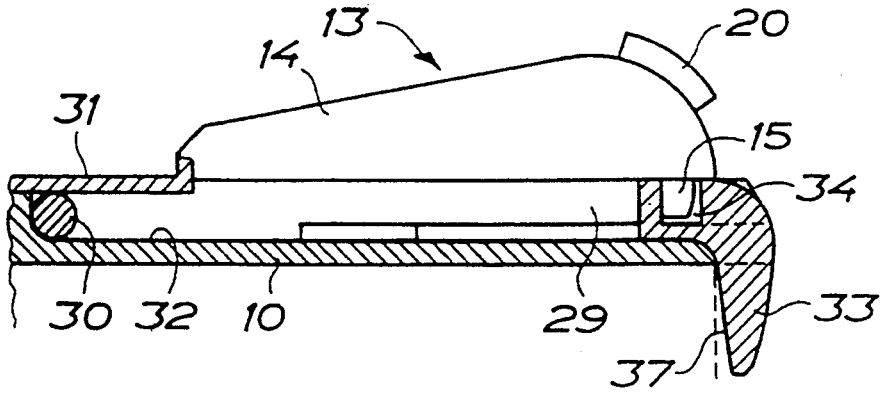
Figure 3:
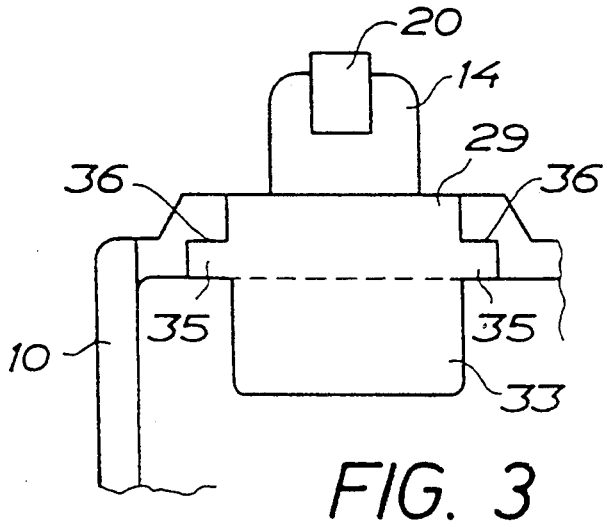
Figure 4:
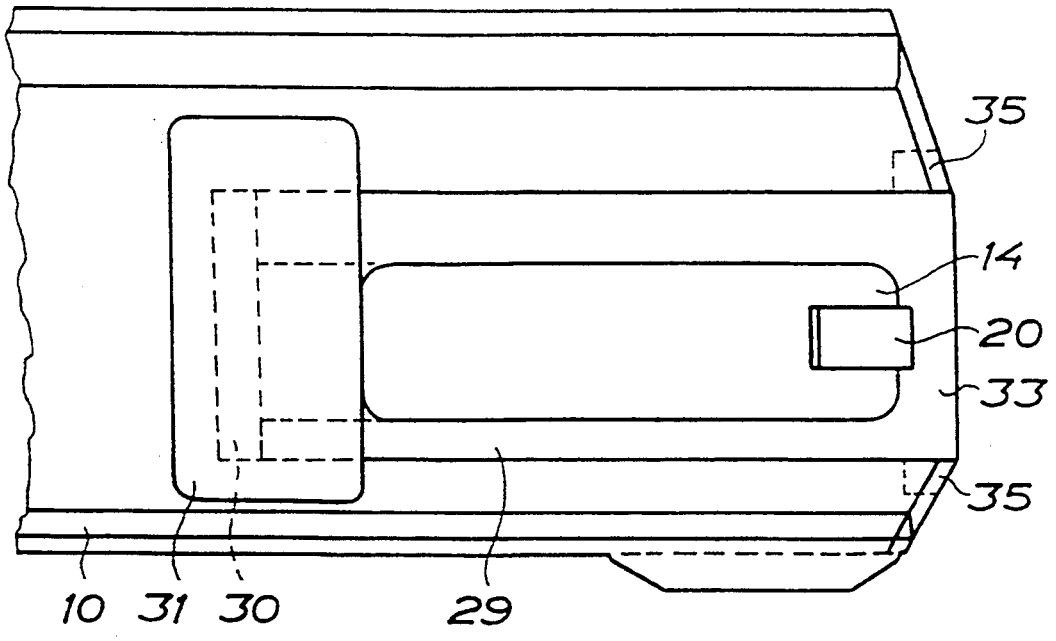
Figure 5:
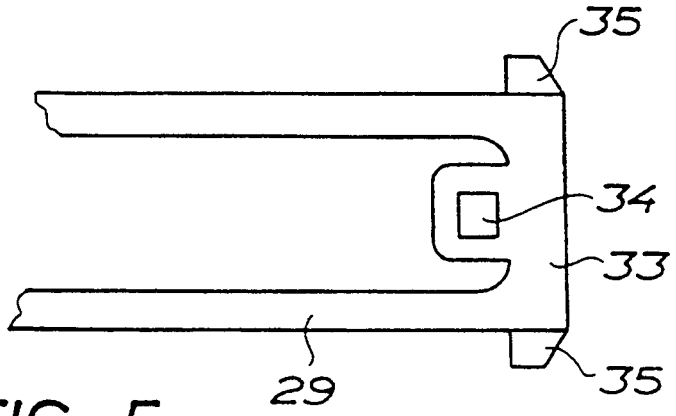
Figure 6:
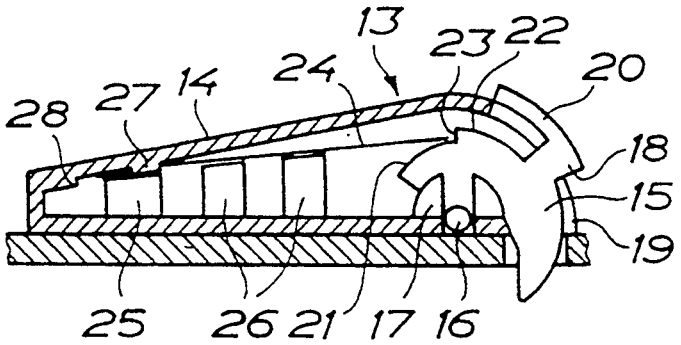
Figure 7:
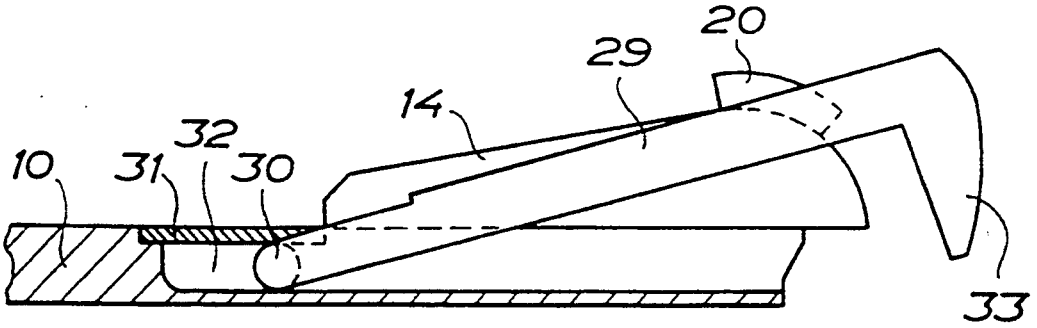

In order to explain the invention in more detail reference is made to the accompanying drawings in which FIG. 1 is a side view of a theft-prevention device according to the invention intended for a video cassette with a cardboard box, FIG. 2 is an enlarged side view, partly a vertical cross sectional view, of the lock means proper, shown in engaged position, FIG. 3 is an end view of the lock means, FIG. 4 is a plan view of the lock means, FIG. 5 is a fragmentary plan view of the lock tongue, FIG. 6 is a vertical cross sectional view of the lock mechanism and, FIG. 7 is a view similar to FIG. 2 but showing the lock means in the disengaged position.

The theft-prevention device shown in FIG. 1 comprises in a known manner a sturdy frame 10 of durable plastic, which is constructed to enclose a parallelepipedic box, e.g. a cardboard box for a video cassette, on the flat sides and three narrow sides thereof, viz. the two short sides and one long side, while the other long side 11 forms an insert opening for the insertion of the box into the frame and for withdrawal of the same therefrom. The frame shall be provided in a manner known per se and not shown here in detail, with a sensor formed as a dipole or a tape, for the actuation of an electric alarm system. Sensors of different types are known per se, and the purpose thereof is that when they are carried through an electrostatic or magnetic field between two bows defining a passage in the exit of a shop or department store, they provide a disturbance of this field such that alarm means will be actuated via electronic circuits. This is a theft-prevention technique which is well known per se. Lock means 12 are provided on one short side of the frame to block the insert opening but the insert opening can also, of course, be provided at a short side and the lock means then be located on one of the long sides.

The lock means 12 comprises a lock mechanism 13, FIGS. 2 and 6, of the embodiment shown and described in SE-B-461 121 having a lock housing 14 which consists of the same plastic as the frame 10 and is attached to the frame by ultrasound welding or in another way which provides a homogeneous connection. The lock housing 14 can have a bottom but the bottom thereof can also be formed by the frame 10. A rotary bolt 15 is rotatably mounted at pins 16 in two slotted bearing lugs 17 mutually spaced in the transverse direction of the frame 10. The rotary bolt can consist of fiber reinforced hard plastic or of pressure molded aluminium so that it is difficult to damage or break the rotary bolt. On a stem 18 which projects from the rotary bolt through a slot 19 in the lock housing 14 a finger grip 20 is provided said finger grip being available outside the lock housing. Moreover, two circulary curved edge surfaces 21 and 22 having the center on the axis of the pins are provided on the rotary bolt. One edge surface 21 has a smaller radius than the other one 22 so that there is provided between the surfaces a shoulder 23. A spring blade 24 of a material that can be attracted by a magnet, is clamped at one end thereof against a support 25, and the spring blade is biassed such that it is pressed at the other, free end thereof against the rotary bolt. Moreover there are provided two spring blade supports 26 which are located between the ends of the blade and prevent bending of the blade inwards when a pressure is exerted on the spring blade. For further localization of the spring blade 24 a projection 27 is provided on the lock housing 14 said projection engaging an aperture in the spring blade in the region of the support 25. Additionally, the spring blade is supported by a shoulder 28 on the inside surface of the lock housing 14.

The position of the lock means shown in FIG. 6 is the engaged position of the lock means wherein the free end of the spring blade 24 engages the surface 21 and is located immediately in front of the shoulder 23, which means that the spring blade in this position prevents rotation of the rotary bolt at the finger grip 20 from the engaged position thereof in which the rotary bolt projects from the lock housing.

In order that the rotary bolt can be rotated clockwise to the engaged position in which the rotary bolt is withdrawn into the lock housing it is necessary to move the spring blade 24 from the shoulder 23. This is done by the spring blade being attracted to a powerful magnet which is moved towards the lock housing from the outside thereof. The spring blade should be so stiff that in the engaged position thereof it cannot be bent aside by the rotary bolt being actuated at the finger grip 20. A very powerful electromagnet or permanent magnet of high quality magnet material is required in order to bend the spring blade to the disengaged position. In the disengaged position the shoulder 23 of the rotary bolt can be rotated past the free end of the spring blade counter clockwise as seen in FIG. 6 to the disengaged position by the rotary bolt being operated manually at the finger grip 20 the rotary bolt being withdrawn into the lock housing.

Means can be provided for arresting the rotary bolt in the disengaged position thereof so that the handling of the theft-prevention device will be facilitated. It is also possible to exclude the finger grip 20 and to effect the manual adjustment of the rotary bolt by means of a pin or the like which is inserted through the slot 19, said pin being inserted into a depression or an aperture in the rotary bolt when it is desired to adjust, the bolt manually.

The lock means also includes a lock tongue 29 which is mounted at one end thereof on the frame at two coaxial cylindrical transverse pins 30 said pins being pivotably and displaceably guided for movement in the transverse direction thereof in a space 32 defined between the frame 10 and a lid 31 connected to the frame. The lock tongue 29 extends at each side of the lock housing 20 and forms at the other end thereof a hook 33 which is sufficiently large so as to extend a distance downwards over the insert opening along the long side 11 in the position of the lock tongue 29 shown in FIG. 2. On the upper side thereof the lock tongue has a cut out 34 which is dimensioned to receive the rotary bolt 15 when it is in the engaged position thereof according to FIGS. 1 and 2 and then the rotary bolt prevents displacement of the lock tongue which at the same time is prevented from swinging upwards because the lock tongue in the position in which it is locked by means of the rotary bolt is located partly under the lock housing 14 connected to the frame 10. Moreover, the lock tongue 29 has at the sides thereof projections 35 which are received in grooves 36 in the frame 10 in the engaged position of the lock tongue 29 and thus also prevent the lock tongue from being swung upwards.

When the lock mechanism is in the engaged position and keeps the lock tongue 29 locked in the position disclosed in FIG. 2, the hook 33 of the lock tongue 29 thus partly blocks the insert opening along the long side 11 so that a box which displaceably fits into the frame and has been pushed thereinto through the insert opening cannot be withdrawn from the frame. By the rotary bolt being brought into the disengaged position in the manner described above the lock tongue 29 can, however, be freely displaced to the right as seen in FIG. 2 in order then to be swung upwards to the position according to FIG. 7, wherein the hook 33 no longer blocks the insert opening so that the box can again be withdrawn from the frame. The hook 33 has a small chamfer 37 on the side facing the box so that it is not necessary after the rotary bolt having been brought to the disengaged position to move the lock tongue 29 away manually when the box shall be withdrawn from the frame. When the box is withdrawn the lock tongue will be carried along by the box in order then to be cammed to the position according to FIG. 7 against the edge of the box when the lock tongue 29 is free to swing. Moreover, the lock tongue 29 can be biassed towards the right as seen in FIG. 2 in a suitable manner in order to be projected from the position shown in FIG. 2, when released as the rotary bolt is brought to the disengaged position thereof.

The lock means described including the lock mechanism and the lock tongue can of course be used in another connection than in connection with theft-prevention. Wherever a locking engagement between two parts shall be provided this lock means can be used.

The lock mechanism described with the rotary bolt is preferred because such a lock mechanism can be made small and compact, but it is within the scope of the invention to provide a lock means of another type for example a lock mechanism which has a linearily displaceable lock bolt or a pivoted clasp. The latch mechanism which keeps the lock bolt in the engaged position thereof can be operated mechanically by means of a key or the like, but the latch mechanism which can be actuated magnetically is preferred due to the fact that the latch mechanism and the apparatus used to operate the same as a consequence thereof will be simpler and very safe as to function.

I claim:

1. A theft prevention device for a box comprising:

a) a frame, said frame being adapted to conform to the dimensions of the box, said frame including an insert opening;

b) means for locking the insert opening, the locking means being movable between a first engaged position, where the insert opening is blocked, and a second disengaged position where the insert opening is not blocked;

c) means for slidably and pivotally mounting the locking means to said frame, said mounting means being connected to said frame;

d) restraining means for preventing pivotal movement of the locking means when the locking means is in the first engaged position, the restraining means being connected to the frame; and e) a latch operatively connected to the locking means for selectively releasing the locking means, the latch being movable between a first position where the locking means can not be displaced and remains engaged, where the insert opening is blocked, and a second position where the locking means may be displaced and disengaged, such that the insert opening may be unblocked.

2. The device according to claim 1, wherein the latch comprises a rotary bolt.

3. The device according to claim 2, wherein the locking means additionally comprises a cut out portion for receiving and engaging the rotary bolt.

4. The device according to claim 1, wherein the locking means includes side projections cooperatingly configured to fit within the restraining means.

5. The device according to claim 1, wherein the locking means additionally comprises a hook.

6. A theft prevention device for placement on a parallelepipedic box comprising: a frame for enclosing the box, the frame including an insert opening for the box and oppositely disposed groves, means for blocking the insert opening, the blocking means being movable between an engaged position where the insert opening is blocked and the box can not be removed from the frame, and a disengaged position where the insert opening is not blocked and the box can be removed from the frame, the blocking means including a lock element being slidably and pivotally mounted to the frame, the lock element having oppositely disposed projections cooperatingly configured to fit within the oppositely disposed groves of the frame when the blocking means is in the engaged position, the projections for preventing the blocking means from being swung upward while in this engaged position, and latch means operatively connected to the lock element for selectively releasing the blocking means from the engaged position, whereby when the blocking means is released from the engaged position and moved to the disengaged position, it can be swung upwards to clear the insert opening, allowing for removal of the box from the frame.

7. The theft prevention device according to claim 6, wherein the latch means comprises a rotary bolt for engaging the lock element, when the blocking means is in the engaged position for preventing displacement and pivoting of the lock element.

8. The theft prevention device according to claim 6, wherein the blocking means additionally includes a hook.

9. The theft prevention device according to claim 8, wherein the lock element forms a cut out for engagement with the rotary bolt.

* * * * *